US008524010B2

(12) United States Patent
Nordlund et al.

(10) Patent No.: US 8,524,010 B2
(45) **Date of Patent: *Sep. 3, 2013**

(54) TRANSPORTABLE INTEGRATED WASH UNIT

(75) Inventors: Johan Sebastian Nordlund, Hasselby (SE); Henrik Amcoff, Järfälla (SE); Rodney W. Kohler, Apollo Beach, FL (US); Thomas Wagner, Troy, NY (US)

(73) Assignee: EcoServices, LLC, Farmington, CT (US)

( * ) Notice: Subject to any disclaimer, the term of this patent is extended or adjusted under 35 U.S.C. 154(b) by 379 days.

This patent is subject to a terminal disclaimer.

(21) Appl. No.: 12/041,346

(22) Filed: Mar. 3, 2008

(65) Prior Publication Data

US 2008/0272040 A1 Nov. 6, 2008

Related U.S. Application Data

(60) Provisional application No. 60/905,650, filed on Mar. 7, 2007.

(51) Int. Cl.
*B08B 3/02* (2006.01)

(52) U.S. Cl.
USPC ..... 134/56 R; 134/113; 134/123; 134/168 R; 134/184

(58) Field of Classification Search
USPC ..... 134/123, 56 R, 99.1, 100.1, 14.4, 134/110, 113, 167 R, 168 R, 169 R, 172, 134/184, 186, 198
See application file for complete search history.

(56) References Cited

U.S. PATENT DOCUMENTS

| | | | | |
|---|---|---|---|---|
| 4,059,123 | A * | 11/1977 | Bartos et al. | 134/102.2 |
| 5,011,540 | A | 4/1991 | McDermott | 134/23 |
| 5,104,068 | A | 4/1992 | Krilla et al. | |
| 5,244,579 | A * | 9/1993 | Horner et al. | 210/652 |
| 5,318,254 | A | 6/1994 | Shaw et al. | 244/134 |
| 5,500,976 | A * | 3/1996 | Rohrbacher et al. | 15/320 |
| 5,577,522 | A * | 11/1996 | Barkley et al. | 134/111 |
| 5,667,683 | A * | 9/1997 | Benian | 210/409 |
| 5,899,217 | A | 5/1999 | Testman, Jr. | 134/104.4 |
| 6,481,448 | B2 * | 11/2002 | Mathieu | 134/109 |
| 6,675,437 | B1 | 1/2004 | York | 15/321 |
| 6,932,093 | B2 * | 8/2005 | Ogden et al. | 134/22.1 |
| 7,179,369 | B2 | 2/2007 | Dohnal et al. | |
| 2002/0001255 | A1 | 1/2002 | Flood et al. | 366/8 |

(Continued)

FOREIGN PATENT DOCUMENTS

| | | |
|---|---|---|
| DE | 2701823 | 8/1977 |
| DE | 94 20 362.8 | 3/1995 |

(Continued)

OTHER PUBLICATIONS

European Search Report, mailed Jun. 28, 2011.

*Primary Examiner* — Joseph L Perrin
(74) *Attorney, Agent, or Firm* — Kinney & Lange, P.A.

(57) ABSTRACT

A transportable wash unit comprises a wash fluid delivery system for delivering wash fluid to a desired washing location; a power supply for providing power to components of the transportable washing unit; a unit controller for controlling one or more components of the transportable wash unit; and a mobility unit for mobilizing the transportable wash unit.

37 Claims, 5 Drawing Sheets

(56) References Cited

U.S. PATENT DOCUMENTS

| | | | | |
|---|---|---|---|---|
| 2002/0122730 | A1 | 9/2002 | Dexter et al. | |
| 2002/0161343 | A1* | 10/2002 | Castles | 604/290 |
| 2003/0116646 | A1* | 6/2003 | You | 239/373 |
| 2003/0150936 | A1* | 8/2003 | Bristor | 239/307 |
| 2003/0209256 | A1 | 11/2003 | Tadayon | 134/10 |
| 2004/0238419 | A1* | 12/2004 | Dohnal et al. | 210/87 |
| 2006/0048796 | A1 | 3/2006 | Asplund et al. | |
| 2006/0048797 | A1* | 3/2006 | Jung et al. | 134/21 |
| 2006/0081521 | A1 | 4/2006 | Hjerpe et al. | |
| 2006/0083374 | A1* | 4/2006 | Drake et al. | 380/203 |
| 2006/0230056 | A1* | 10/2006 | Aaltonen | 707/102 |
| 2007/0227558 | A1* | 10/2007 | Chase | 134/18 |
| 2008/0149139 | A1* | 6/2008 | Lin et al. | 134/18 |
| 2009/0050183 | A1 | 2/2009 | Rice et al. | 134/107 |

FOREIGN PATENT DOCUMENTS

| | | | |
|---|---|---|---|
| EP | 0 628 477 | | 12/1994 |
| EP | 1 574 675 | A2 | 9/2005 |
| EP | 1 914 010 | A2 | 4/2008 |
| EP | 1 927 408 | A2 | 6/2008 |
| KR | 10-1998-0017193 | | 6/1998 |
| RU | 2 194 632 | C1 | 12/2002 |
| WO | WO 2004/055334 | A1 | 7/2004 |
| WO | WO 2005/077554 | A1 | 8/2005 |
| WO | WO 2005/120953 | A1 | 12/2005 |
| WO | WO 2005/121509 | A1 | 12/2005 |
| WO | WO 2008/025940 | A1 | 3/2008 |

* cited by examiner

TRANSPORTABLE INTEGRATED WASH UNIT

RELATED APPLICATION

The present application claims priority from U.S. Provisional Patent Application Ser. No. 60/905,650 filed Mar. 7, 2007. This earlier provisional application is hereby incorporated by reference.

TECHNICAL FIELD

The present disclosure relates to a transportable integrated wash unit, and more particularly, to a transportable integrated wash unit configured for use in cleaning turbine compressors.

BACKGROUND

Gas turbine compressors are used in a variety of industrial applications. For instance, gas turbine compressors may be installed in aircrafts for proving aircraft propulsion. They may even be utilized as stationary power generators and/or stationary mechanical drive. Regardless of the application, gas turbine compressors all consume very large quantities of air. In operation, a gas turbine compressor first compresses air, mixes the compressed air with fuel, and then burns the fuel-air mixture to create expanding gas. This expanding gas in turn drives the turbine compressor and produces torque. The resultant torque may be used, for example, to drive propulsion fans, electric generators, and/or other devices such as mechanical pumps.

In many turbine compressor applications, including those discussed above (with the exception of an aircraft propulsion application), air inlet filtering is employed in an effort to prevent contaminants from entering and hampering the turbines' operations. As can be appreciated by those in the art, however, this type of filtering does not altogether prevent small concentrations of contaminates from entering and adhering themselves to turbine compressor blades. These small concentrations eventually accumulate on the compressor blades and decrease the effectiveness of the blades in a manner that reduces total air flow and total produced power from the gas turbine.

One manner of preventing degradation and of reversing the surface modifying or fouling effects of contaminants is through proper and routine compressor cleaning. Routine cleaning of compressors helps maintain turbine engine performance, emissions performance, and intended air flow at their best. Maintaining the intended air flow also assists in maintaining an optimal fuel to air mixture, which further improves the performance and life of compressors.

Existing methods and equipment utilized in cleaning aero-engine compressors are described in various patents or applications, all of which are incorporated herein by reference. For example, one such compressor cleaning system is disclosed in International Publication No. WO 05077554, entitled "Method and Apparatus for Cleaning Turbofan Gas Turbine Engines" and its corresponding United States Published Patent Application No 2006/0048796. Disclosed therein is a cleaning device comprising a plurality of nozzles arranged on a manifold, which manifold is releasibly mounted on the air inlet of the engine, and where the nozzles are arranged to atomize and direct cleaning liquid in the air stream up-stream of a fan of the engine.

The device as disclosed in WO 05077554 comprises a first nozzle arranged at a first position relative a centre line of the engine such that the cleaning liquid emanated from the first nozzle impinges the surfaces of the blades substantially on the pressure side of the fan; a second nozzle arranged at a second position relative the centre line of the engine such that the cleaning liquid emanated from the second nozzle passes between fan blades and impinges the surfaces of the blades substantially on the suction side of the low pressure compressor; and a third nozzle arranged at a third position relative the centre line of the engine such that the cleaning liquid emanated from the third nozzle passes substantially between the blades and enters an inlet of the core engine. A specific design washing configuration, including flow rate, atomized droplet size, is prepared for each specific engine such that atomization and nozzle position are optimized to achieve effective cleaning.

Thus, the invention disclosed in WO 05077554 is based on the insight that the engine geometry and properties of the fouling of different components of the engine have different properties and therefore, require different approaches for the cleaning. As an example, the fouling of a core compressor may have different properties than fouling found on the blades of a fan. One possible reason for this discrepancy in fouling properties may include, for example, that the temperature is much higher at the compressor than at the blades of a fan. The high temperature at the compressor results in fouling particles becoming "baked" onto the compressor's surface, thereby making removal of such fouling extremely difficult. At the fan blades, however, the temperature is much lower. As a result, the fouling at the fan does not become baked, making it much easier to clean fan fouling.

Another aspect of the cleaning aero-engine compressors includes the proper collection and disposal of washing liquids used to clean the compressors, and any contaminants removed from the aero-engines during a cleaning process. Due to environmental concerns, used washing liquids may be purified and recycled, such as is described in International Publication No. WO 05120953, entitled "System and Devices for Collecting and Treating Waste Water from Engine Washing". Disclosed therein is an aero-engine washing device having a collector arranged at its rear arrangement for collecting used washing liquids. Waste wash liquid emanating from an engine is collected by this collecting device at the rear of the engine.

The system described in International Publication No. WO 05120953 may be made mobile by the introduction of a mobile vehicle. In operation, the washing device may be mounted or positioned onto a hand-towed cart, a motor driven cart, a motor vehicle (e.g., small truck), or the like.

Another example of a waste water collecting device is described in International Publication No. WO 05121509, titled "System and Devices for Collecting and Treating Waste Water from Engine Washing", and its corresponding United States Published Patent Application No. 2006/0081521. As disclosed therein, collected waste liquid is pumped into a tank where released fouling material is separated from the collected liquid by an appropriate waste water treatment process. The treated water is then used for either washing additional engines or is alternatively dumped into a sewer.

The above mentioned systems and methods for cleaning engines and/or collecting and recycling used washing liquids provide very versatile and effective cleaning methods that can be arranged on a mobile unit. These systems and methods, however, are not truly fully integrated or self-contained. In other words, each of the above systems requires, to some extent, some form of external resource.

To illustrate, conventional aero-engine (and/or mechanical drive unit) cleaning systems typically require an external source of clean water, (preferably less than five (5) parts-per-million (ppm) total dissolved solids, a power source for heating cleaning solution and driving a cleaning process, a pump to deliver water/wash fluids to the aero-engine, a manifold to direct and atomize the water/wash fluids, and a collection system for capturing used wash fluids (i.e., cleaning effluent) to prevent environmental release. Stationary gas turbine compressor cleaning systems, for example, are typically positioned on a permanently placed skid and require siting of external resources such as a clean water source, power to heat and deliver cleaning solution, a pump system to deliver the cleaning solution, and permanently mounted nozzles within the gas turbine inlet to properly direct the cleaning solution.

Due to the high costs and limited annual use of such a cleaning system, however, some gas turbine operations, (e.g., typically peaking or portable rental units), do not site a permanently mounted skid and forgo routine cleaning of their gas turbines. As can be appreciated by those in the art, forgoing routine turbine cleaning can reduce machine output by up to one-percent (1%) per accumulated month of operation, depending on climate and site. This type of loss to efficiency typically results in higher than optimal emissions performance. Although this increased emissions performance may be within permit levels initially, the emissions rate will continue to deteriorate as contaminants continue to build on compressor blades over time.

Accordingly, it would be desirable to have a cost-effective, portable, self-contained cleaning system for cleaning gas turbine compressors. Additionally, it would be desirable to have a cleaning system and process for rapidly cleaning such turbine compressors while utilizing minimum volumes of water and/or washing fluids.

SUMMARY

The present disclosure relates to systems and methods relating to a transportable integrated wash unit. An exemplary transportable wash unit may comprise a wash fluid delivery system for delivering wash fluid to a desired washing location; a power supply for providing power to components of the transportable washing unit; a unit controller for controlling one or more components of the transportable wash unit; and a mobility unit for mobilizing the transportable wash unit.

DETAILED DESCRIPTION

Figure 1A:
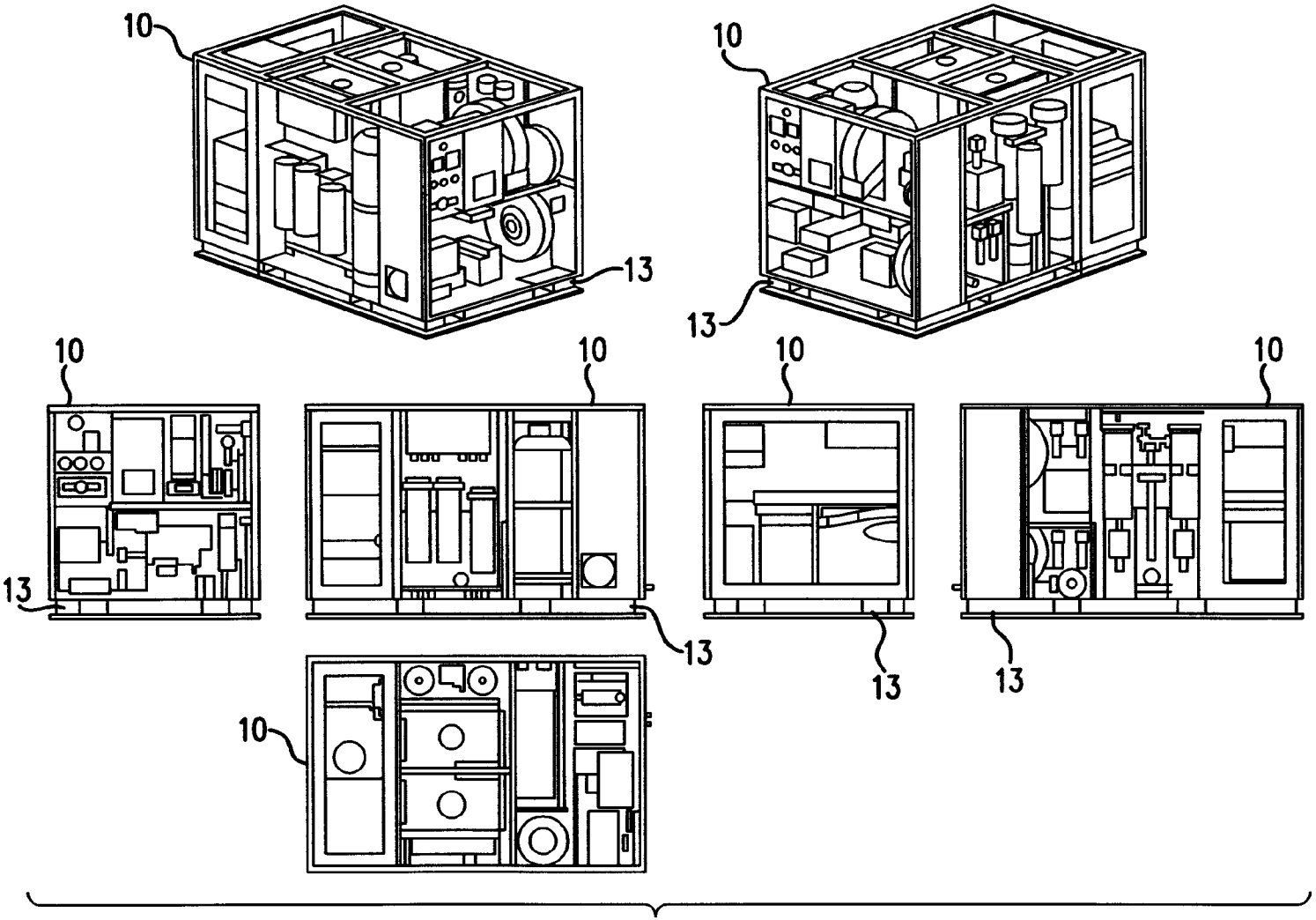
FIG. 1A illustrates several isometric views of an exemplary transportable integrated wash unit.

Disclosed herein are systems and methods relating to a transportable integrated wash unit for use in cleaning gas turbine compressors. More particularly, the present disclosure describes systems and methods wherein all necessary components of a compressor cleaning system are integrated on a transportable vehicle. Such an integrated system allows for great flexibility and diverse applicability. For example, the systems and methods disclosed herein may be implemented to effectively wash compressors of free moving gas turbines, such as those used to power aircrafts. In addition, the systems and methods of the present disclosure are applicable (and cost-effective enough) for use in cleaning compressors of stationary gas turbines, including those that lack a dedicated compressor cleaning system (e.g., peaking, rental units, and mechanical drive turbine operations).

Several advantages of the present disclosure includes the lack of a need for various external resources (e.g., external water source, power supply, etc.) and improved performance and extended service intervals of compressors resulting from the effective cleaning methods of the disclosure. An additional advantage of the disclosure includes reduced total emissions, which adds anywhere from one percent (1%) to five percent (5%) of total compressor output (on an annualized basis) as compared to unwashed compressor units. As further detailed below, the systems and methods of the present disclosure may employ conventional working pressures such as one to five bar, although more effective working pressures may be utilized in accordance with the present disclosure. For instance, International Publication No. WO 2004/055334 A1, entitled "A Method of Cleaning a Stationary Gas Turbine Unit During Operation", discloses pressure, droplet size, and air velocities that may be utilized for cleaning gas turbine units.

The transportable integrated wash unit disclosed herein comprises several elements which as further detailed below, may be categorized into one of several system groups. A first element of the transportable wash unit may comprise a gas or diesel powered engine-generator set to power the wash process. This engine-generator set may be controlled and overseen by an integrated unit controller, for example. It is noted that in applications utilizing a stationary gas turbine wash system embodiment, this power element may not be needed, as power may be provided by a stationary plant location, for example.

A second element of the wash unit may comprise one or more reservoir tanks for holding wash fluid. For purposes of the present disclosure, the term "wash fluid" may be used to describe demineralized water, washing liquid comprised of any combination of water and/or washing elements, and/or any other liquid suitable for use in washing turbines and/or turbine compressors.

The one or more reservoir tanks may be sized as desired, such as for holding enough fluid to complete one or two wash processes. The tanks may be equipped with sensors for indicating water/wash fluid levels, temperature, quality, and other notable parameters. The information gathered by the tank sensor(s) may be communicated to an integrated controller unit for use in controlling reservoir tank fill, heating, wash processes, and etc.

A third element of the transportable wash unit may comprise a supply means (e.g., supply pump) for delivering water and/or washing fluid to a manifold. The manifold may be portable for use in cleaning mobile or aero turbines, or permanently fixed for use in cleaning stationary turbines. In either implementation, the manifold may include one or more nozzles for atomizing and directing washing fluid to an area desired to be cleaned. The supply means may be sized to deliver wash fluid at any desired pressure, including pressures designated by OEMs (original equipment manufactures), which is typically between one (1) and five (5) bar, or at even higher pressures.

A fourth element of this disclosure may comprise the presence and powering of ancillary equipment such as hand tools, air compressors, etc. These ancillary tools may be used, for example, to prepare a turbine for washing (e.g., removing covers and/or other obstructions), for re-assembling (i.e., returning to operational condition) the turbine once a washing process is completed, and/or in the case of a compressor, for purging wash manifolds and/or engines to remove fluid that could potentially leak into the engine during its next use.

A fifth element of the transportable wash unit may comprise a water treatment means for treating used fluid (e.g., water, washing liquid, etc.) to achieve a desirable fluid quality (e.g., less than five (5) parts-per-million (ppm) total dissolved solids). Once the fluid is treated, the wash unit of the present disclosure may reuse the treated fluid.

As noted above, these and other elements of the transportable wash unit disclosed herein may be categorized into one of several system groups. These categorizations, however, are provided for purposes of illustration and should not be interpreted as limiting.

A first system category of a transportable wash unit may be described as a wash fluid delivery system. As its name implies, the function of this system is to deliver wash fluid to a desired washing location. In an exemplary embodiment, the wash fluid delivery system may comprise, for example, one or more reservoir tanks for storing washing fluid, a manifold, in communication with the reservoir tank(s), having one or more nozzles for directing the washing fluid to a desired washing location, and a supply pump for delivering the washing fluid from the reservoir tank(s) to the manifold.

Each of the reservoir tank(s) may be sized to store any desired volume of washing fluid, including, for example, between eighty (80) and one-thousand five hundred (1,500) liters. Other tank sized may be utilized in accordance with the present disclosure according to the particular implementation. In addition, each of the reservoir tank(s) may include one or more sensors. The sensor(s) may be used to provide information regarding the fluid stored in the tanks. To illustrate, the sensor(s) may be used to indicate fluid parameters such as fluid level, fluid temperature, fluid quality, etc. As further detailed below, this type of information may be provided to a unit controller for use in setting/maintaining operating parameters of the transportable wash unit. Further, the reservoir tank(s) may be equipped with one or more heating elements for use in heating wash fluid stored within the reservoir tank(s). As known to those in the art, heated wash fluid is typically more effective than non-heated wash fluid. Thus, the heating elements may be configured to heat wash fluid to between fifty (50) and eighty (80) degrees Celsius, for example, or to any desired temperature appropriate for the particular application.

As explained above, a manifold in communication with the reservoir tank(s) may be provided for delivering wash fluid to a desired location. This manifold may be one of a portable or a fixed manifold comprising a desired number of nozzles for directing the wash fluid as desired. In a stationary wash system application, for example, the manifold may be stationary. Alternatively, a portable manifold may be utilized in aero wash system applications. In addition, the manifold/nozzles may be configured to atomize the wash fluid as it passes there-through.

The supply pump for delivering wash fluid from the reservoir tank(s) to the manifold may be configured for example, to deliver from between three (3) and two-hundred forty (240) liters of wash fluid per minute at pressures of between one (1) and eighty (80) bars. It should be noted, however, that supply pump is not limited to these operating parameters. To the contrary, the supply pump may be configured to deliver wash fluid at any desired rate/pressure as appropriate for the particular application. A control mechanism such as, for example, a frequency drive may be used to control the operating parameters of this supply pump.

A second system category of the transportable wash unit may be described as a fluid treatment system. As its name implies, the function of this system is to treat used wash fluid, thereby enabling the wash unit to re-use the fluid. In an exemplary embodiment, the fluid treatment system may comprise, for example, a collector for capturing used wash fluid as it exits a washed turbine and a holding tank for holding and supplying the captured fluid to the treatment system. In addition, the fluid treatment system may be configured to treat potable water, which, as known to those in the art, includes water that contains water treatment chemicals and/or minerals such as chlorine, for example. This feature may be desirable in a stationary wash unit implementation, or in implementations in which water is provided from a source that is external to the wash unit itself (e.g., where water is provided from the stationary plant).

The fluid treatment system may be configured to receive the used wash liquid/potable water and process it at a rate of one gallon of fluid per minute, for example. Such a processing rate may be achieved via a pumping system (e.g., a supplemental pump described below) and filter(s) configured to pump and pass fluid at the one gallon per minute rate. Alternatively, the treatment system may be configured to process fluid at a faster or slower treatment rate, as deemed appropriate for the particular application. Once treated, the used wash fluid/potable water may be returned to a usable wash fluid containing little or no dissolved solids therein (e.g., five (5) ppm or less).

For use in treating the used wash fluid, the fluid treatment system may comprise, for example, elements such as carbon filters for removing minerals and chlorine, fiber filter elements, polishing resin, de-ionizing membrane filters for removing ions and thereby returning water to a neutral ph, and/or any other element useful in treating used wash fluid. In addition, the fluid treatment system may comprise a supplemental pump for use in returning treated wash fluid back to the one or more reservoir tank(s) described above.

A third system category of the transportable wash unit may be described as a power supply system. As its name implies, the function of this system is to provide power to the various elements of the transportable wash unit. As noted above, a power supply system may not always be desirable. In implementations wherein the transportable wash unit is utilized for stationary cleaning applications, for example, power may be drawn from the stationary facility.

In an exemplary aero wash unit, the power supply system may comprise, for example, an engine-generator set. The engine of the power supply system may be a reciprocating diesel or gasoline fired engine for driving the generator. The engine may be configured to drive the generator at a voltage of between four hundred (400) and four hundred eighty (480) volts at thirty amperes at three phase power. Alternatively, the engine may be configured to drive the generator as appropriate for the particular application. The generator may be configured as a fifty (50) or sixty (60) hertz capacity generator. Alternatively, the generator may be configured as deemed appropriate for the particular application including, for example, for handling the combined needs of the entire wash unit (e.g., between ten (10) and forty (40) kw).

A unit controller for controlling each of the above-described systems, and the elements therein, may be included in the transportable wash unit. This controller unit may be, for example, an automated controller which itself is controlled by a programmable logic controller (PLC), a personal computer, or the like. Alternatively, the controller unit may be manually controlled via, for example, a controller display unit (e.g., a touch screen) configured for calling predefined wash procedures. In an exemplary embodiment, the unit controller may comprise a reading device that recognizes a particular engine type, wash application, manifold, etc., and based on this recognition, calls (or enables a user to call) a predetermined wash procedure that is optimized for the particular application.

For security, the unit controller unit may be regulated via, for example, a password protection module which prevents non-authorized users (i.e., those without a password) from accessing the controller unit. In one exemplary application, the controller unit may be an integrated unit controller configured to automatically monitor and control the engine-generator set and the reservoir tanks.

Optionally, the controller unit may include a memory for storing data, equipment-specific information, and user-defined washing procedures, for example. These user-defined washing procedures may include controller-callable routines which may be accessed directly or remotely. As noted above, these routines may be called in response to components (e.g., manifold, engine, etc.) sensed or recognized by a reading device. Once a washing procedure routine is called, the controller unit adjusts and controls the various components of the wash unit so as to achieve the called washing procedure. To this end, the unit controller unit may be configured to satisfy user-defined "permissives" (or conditions) such as fluid quality, fluid quantity, fluid temperature, reservoir fill, wash fluid configuration, and the like prior to allowing a wash procedure to commence.

The transportable wash unit of the present disclosure may also include a mobility means for mobilizing the wash unit. This mobility means may itself be integrated into the transportable wash unit and itself mobilize the wash unit, or it may simply facilitate movement of the wash unit. To illustrate, the wash unit may be integrated onto a trailer or truck bed which is itself mobile, or the wash unit may be mounted onto a transportable skid which is not itself mobile, but facilitates movement of the wash unit.

Additional features of the transportable wash unit may include, for example, one or more reels of hoses, each of which may be used for conducting washing procedures, transferring fluid between components of the wash unit, electrically grounding the wash unit, providing a compressed air supply, etc. In addition, one or more of the above-described wash unit elements may be interchangeably attached, thereby facilitating maintenance and replacement thereof. The transportable wash unit may also comprise one or more protective panels for securing and providing weather protection to the various components of the wash unit.

Further, the transportable wash unit described herein may comprise one or more ancillary tools (e.g., hand tools and the like) for use in "preparing" a component (e.g., turbine engine) desired to be washed, and for returning a component back to an operational state once a washing procedure is completed. Preparing a device to be washed may include, for example, removing covers and/or other obstructions of the device to facilitate its washing; and returning the device back to an operational state may include re-assembling device once the washing procedure has been completed.

In addition, an ancillary tool such as a compressor may be incorporated into the wash unit. Compressors may be used, for example, to purge wash manifolds and engines at the conclusion of a washing procedure in order to remove excess fluid that may potentially leak into the engine during the engine's next use, for example.

Figure 1B:
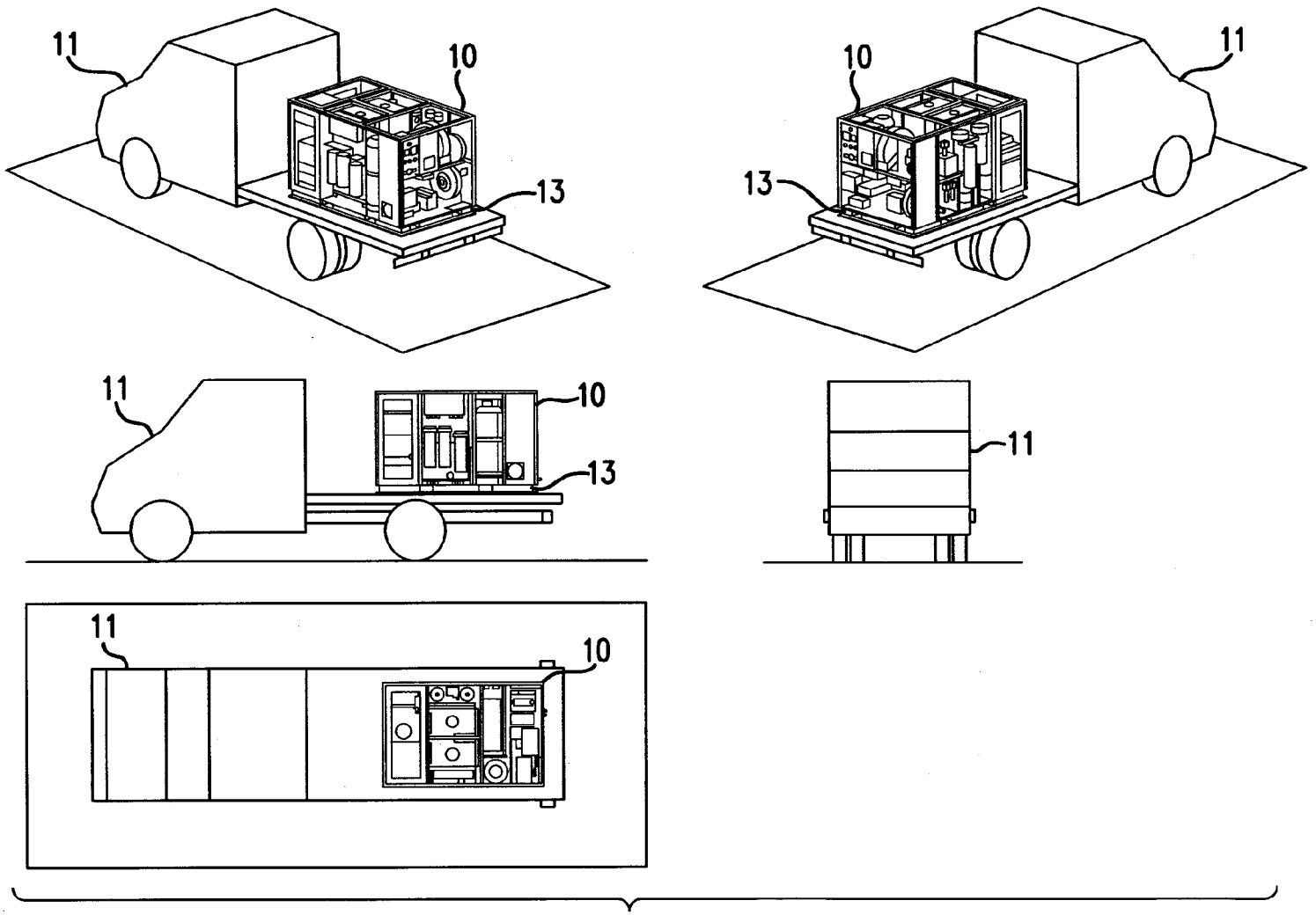
FIG. 1B illustrates several isometric views of an implementation of the transportable integrated wash unit illustrated in FIG. 1A.
Figure 1C:
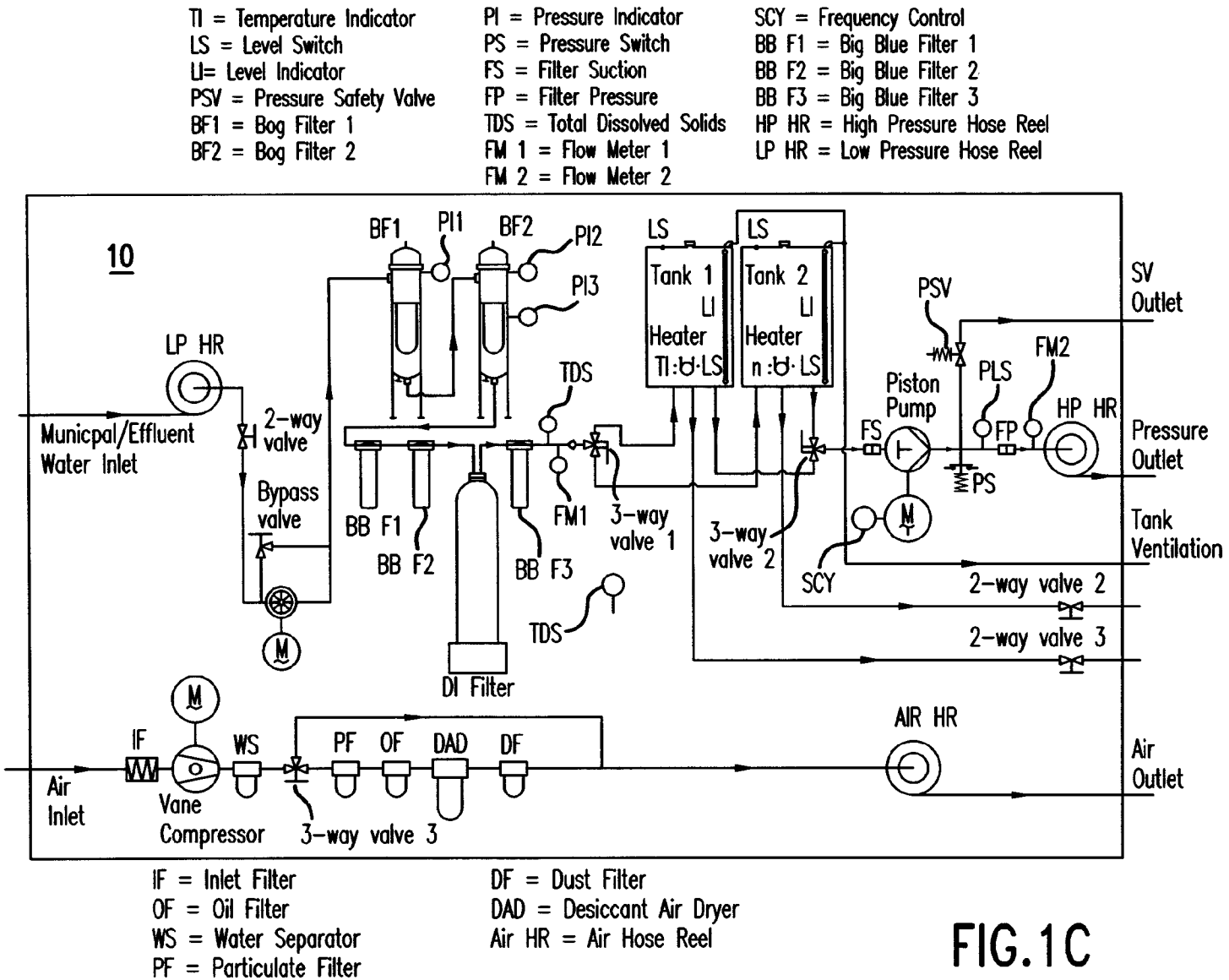
FIG. 1C illustrates a line diagram of the exemplary transportable integrated wash unit illustrated in FIG. 1A.

Turning now to FIGS. 1A-1C, an exemplary transportable integrated wash unit 10 for use on a mobile or aero gas turbine system (e.g., an aircraft engine) is shown. FIGS. 1A and 1B each illustrate isometric views of a transportable wash unit 10 mounted on a transportable skid 13 (FIG. 1A) and mounted onto a truck bed 11 (FIG. 1B). The exemplary wash unit 10 comprises a power engine-generator set for supplying power, for example, to a fill pump for filling the unit's fluid reservoir tanks, to heating elements for heating wash-fluid within the reservoir tanks, and to the unit's wash delivery and fluid treatment systems. The engine-generator set may comprise one of a diesel or gasoline fired engine. The heating elements may be configured to heat wash fluid to any desired temperature such as, for example, to between fifty (50) and ninety (90) degrees Celsius.

Also included in this exemplary wash unit 10 is a controller unit configured to oversee permissives of the unit's 10 washing procedures. This controller unit includes an interface for enabling users to manually operate the controller unit.

As shown in FIG. 1B, the exemplary wash unit 10 may be mounted onto a trailer for use as a mobile wash station. Alternatively, the integrated wash unit 10 may be mounted on a transportable skid 13 (FIG. 1A) for facilitating movement of the wash unit 10 via, for example, a dolly, a trailer, a truck bed, etc.

Referring now to FIG. 1C, a line diagram of the wash unit 10 illustrated in FIGS. 1A and 1B is shown. The exemplary wash unit 10 includes both a water inlet and an air inlet. Water entering the water inlet is passed to a low pass hose reel (LP HR) where it is pressurized and passed to a series of filters (BF1, BF2, BB F1-F3, D1). Once the water is filtered (i.e., once the total dissolved solids in the water is at a desired level), the water is provided to reservoir tanks (Tank 1, Tank 2). In the tanks (Tank 1, Tank 2), the water is heated via respective heating elements. Once the unit controller (not shown) determines that the water is at a desired temperature, the water is provided a piston pump, where it is pumped to a high pressure hose reel (HP RL) for dispensing onto a desired wash location (e.g., an aero turbine engine).

Air input into the exemplary wash unit 10 passes through an inlet filter (IF) and through a vane air compressor in order to remove any water therefrom. The air is then filtered via filters (PF, OF, DAD, DF) and provided to an air hose reel (AIR HR). The AIR HR then dispenses the compressed and purified air onto, for example, the aero engine to purge any excess water from components of the aero turbine system (e.g., manifold, engine, etc.) that may potentially leak into the system after the conclusion of a washing procedure.

Figure 2A:
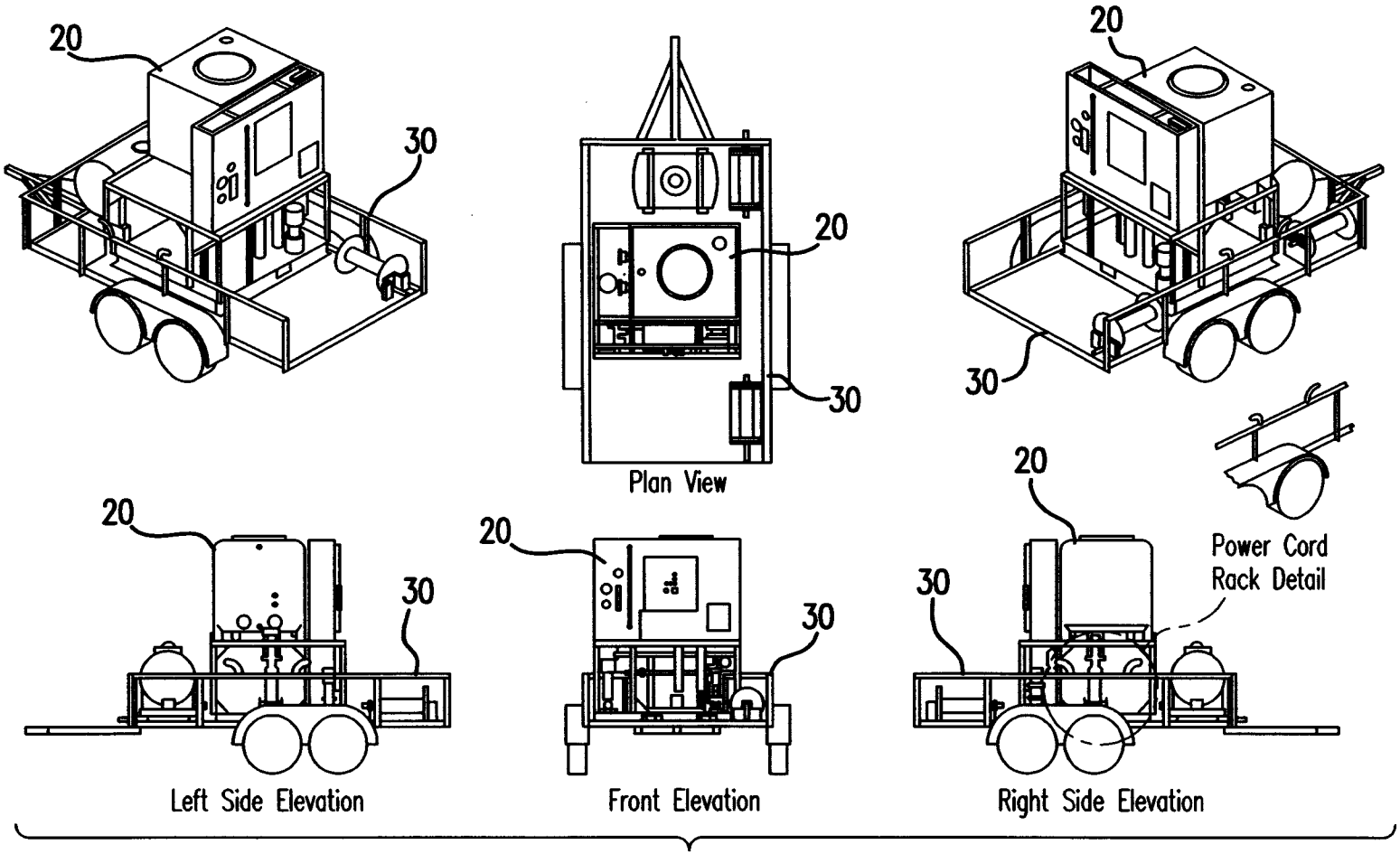
FIG. 2A illustrates an exemplary implementation of a transportable integrated wash unit.
Figure 2B:
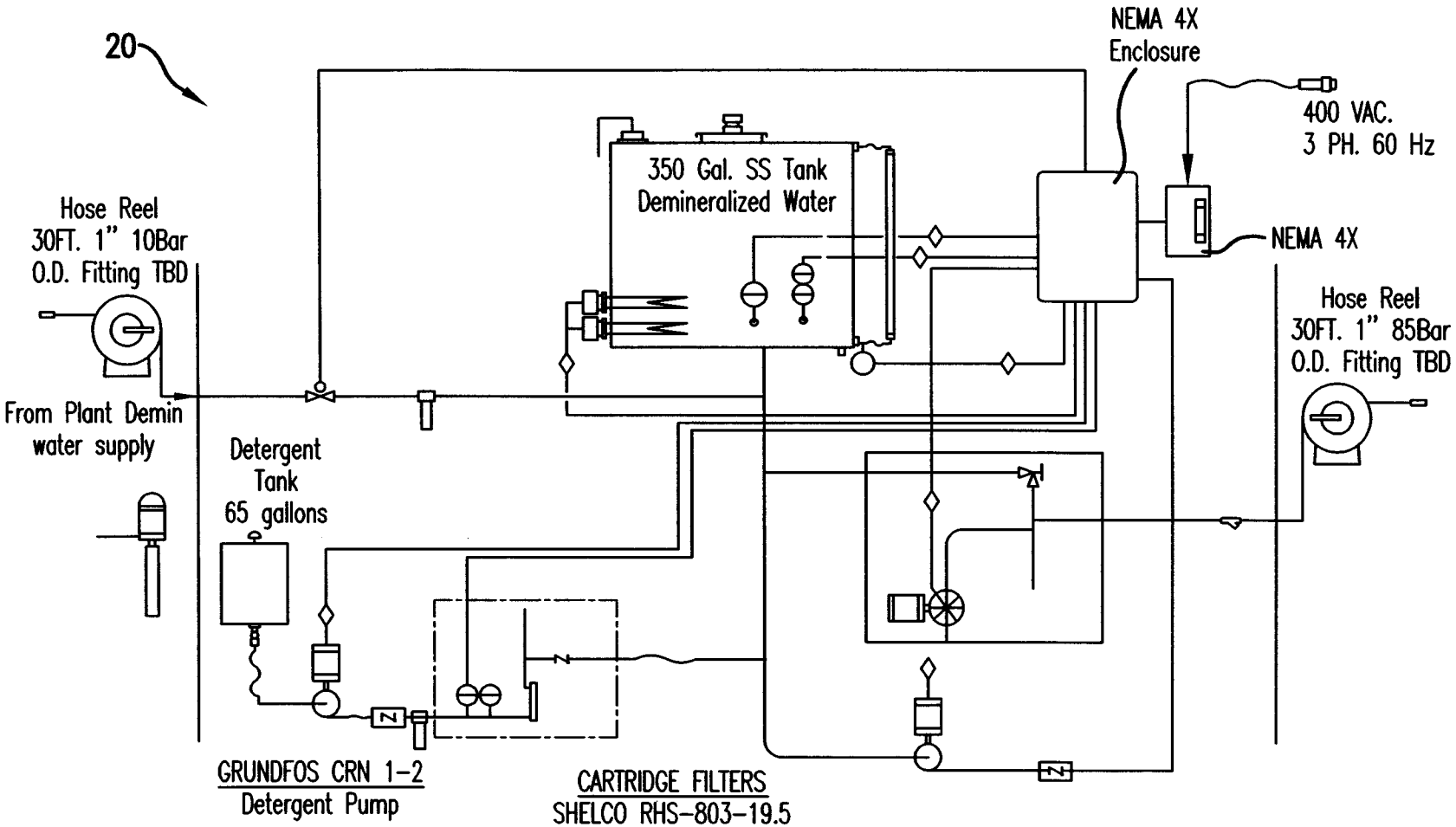
FIG. 2B illustrates a line diagram of the exemplary transportable integrated wash unit illustrated in FIG. 2A.

Referring now to FIGS. 2A-2B, an exemplary transportable integrated wash unit 20 for use on a stationary gas turbine system is shown. FIG. 2A illustrates various isometric views of the stationary wash unit 20 on a mobile cart 30, and FIG. 2B illustrates a line diagram of the wash unit 20 illustrated in FIG. 2A.

As known to those in the art, stationary gas turbines may include those which are immobile, such as turbine systems that are provided as part of a rental business, those used in peaking power generation application, or those used in a mechanical drive business, for example. Rental gas turbines are typically housed on tractor trailer beds, for example, and typically only consist of equipment essential to operate and for transport. Water wash systems are typically omitted from such rental units. Similarly, mechanical drive systems often lack forward planning and are not designed to include a water wash system. Lack of a water wash system results in fouling buildup on the turbines, which results in sub par operating performance. In some cases, fouling build up can cause turbines to lose up to one percent (1%) or more of their total output capabilities. A portable wash system, such as is disclosed herein, can be used to service both rental and mechanical drive systems, thereby minimizing loss of performance caused by such fouling build-up.

Unlike the wash unit 10 illustrated in FIGS. 1A-C, the wash unit 20 of FIGS. 2A-B does not comprise engine-generator set. Power is instead provided to the reservoir tank pumps, heating elements, and other wash unit 20 components via, for example, an on-site power source located at the stationary location of the turbine system. It is noted, however, that an engine-generator set may be included in this exemplary wash unit 20 without departing from the spirit of the present embodiment.

Similar to a power source, the wash unit 20 of the present illustration may or may not include a dedicated wash fluid supply. In the instant illustration, for example, wash fluid is provided from an external source, such as from an off-skid supply or from an on-site supply source. It is noted, however, that the wash unit 20 may nonetheless be equipped with a fill pump and fluid treatment system, thereby enabling the wash unit 20 to treat and re-use used wash fluid or potable water.

Also included in this exemplary wash unit 20 is a controller unit configured to oversee permissives of the unit's 20 washing procedures. This controller unit includes an interface for enabling users to manually operate the controller unit.

As shown in FIG. 2A, the wash unit 20 may be skid-mounted to facilitate transportation of the wash unit 20 such as on a mobile trailer 30 (e.g., as in a wash-unit rental business). Further, the wash unit 20 may be mounted, for example, on a certified highway trailer for transporting the unit 20 from site to stationary turbine site.

Referring now to FIG. 2B, a line diagram of the wash unit 20 illustrated in FIG. 2A is shown. The exemplary wash unit 20 includes both an external water inlet and an external power source. Water provided from an external source (e.g., plant water supply) enters the wash unit 20 via a hose reel. The water is then passed to a filter and onto a demineralized water tank. In the water tank, the water is heated and/or filtered and output to a pump. Optionally, detergent from the detergent tank may be pumped and mixed with the water. The water (or water/detergent mixture) is then provided to an outlet hose reel where it is pressurized and dispensed.

Power is provided to the wash unit from an external power supply (e.g., a power supply from the plant). This external power is introduced into the wash unit via, for example, the NEMA 4X enclosure, where the power is diverted onto the various components of the wash unit 20 (e.g., the various unit pumps, the tank heating elements, etc.).

Although specific embodiments have been shown and described herein for purposes of illustration and exemplification, it is understood by those of ordinary skill in the art that the specific embodiments shown and described may be substituted for a wide variety of alternative and/or equivalent implementations without departing from the scope of the present invention. This disclosure is intended to cover any adaptations or variations of the embodiments discussed herein.

The invention claimed is:

1. A transportable wash unit comprising:

a wash fluid delivery system for delivering wash fluid to a desired washing location;

a power supply for providing power to components of the transportable washing unit;

a unit controller for controlling one or more components of the transportable wash unit, said unit controller comprising a reading device configured to recognize a particular engine type being washed and select a particular wash application based on the particular engine type being washed; and a mobility unit for mobilizing the transportable wash unit.

2. The transportable wash unit of claim 1, further comprising a fluid treatment system for treating used washing fluid.

3. The transportable wash unit of claim 2, further comprising a fluid collection system, said fluid collection system comprising a collector for capturing used wash fluid and a holding tank for holding and supplying the captured fluid to the fluid treatment system.

4. The transportable wash unit of claim 3, wherein the fluid treatment system is configured to receive and treat used wash liquid and potable water.

5. The transportable wash unit of claim 4, wherein the fluid treatment system is configured to process one gallon of fluid per minute.

6. The transportable wash unit of claim 5, wherein the fluid treatment system is configured to return treated fluid to a total dissolved solids level of five (5) parts per million (ppm) or less.

7. The transportable wash unit of claim 6, wherein the fluid treatment system comprises a supplemental pump for returning treatment fluid to the one or more reservoir tanks.

8. The transportable wash unit of claim 7, wherein the fluid treatment system further comprises one or more of a carbon filter, fiber filter elements, polishing resin, and a deionizing membrane filter.

9. The transportable wash unit of claim 1, wherein the wash fluid delivery system comprises:

one or more reservoir tanks for storing washing fluid;

a manifold, in communication with the reservoir tanks, comprising one or more nozzles for directing the washing fluid to a desired washing location; and a supply pump for delivering the washing fluid from the one or more reservoir tanks to the manifold.

10. The transportable wash unit of claim 9, wherein at least one of water and wash fluid is provided from an external source.

11. The transportable wash unit of claim 9, wherein the reservoir tanks comprise one or more sensors for indicating information comprising at least one of a fluid level, temperature and fluid quality of the washing fluid in said tanks, said information being provided to the unit controller.

12. The transportable wash unit of claim 11, wherein each of the one or more reservoir tanks is configured to store between eighty (80) and one-thousand five hundred (1,500) liters.

13. The transportable wash unit of claim 12, wherein the reservoir tanks comprise one or more heating elements for heating wash fluid to between fifty (50) and eighty (80) degrees Celsius.

14. The transportable wash unit of claim 13, wherein the manifold is one of portable or fixed manifold configured to atomize the wash fluid.

15. The transportable wash unit of claim 14, wherein the supply pump is configured to deliver between three (3) liters per minute to two-hundred forty (240) liters per minute to the manifold.

16. The transportable wash unit of claim 15, further comprising a variable frequency drive for controlling the supply pump.

17. The transportable wash unit of claim 16, wherein the supply pump is configured to deliver wash fluid to the manifold at pressures of between one (1) and eighty (80) bars.

18. The transportable wash unit of claim 1, further comprising a power source that external to the wash unit.

19. The transportable wash unit of claim 1, wherein the power supply is integral to the wash unit and comprises an engine-generator set.

20. The transportable wash unit of claim 19, wherein the engine-generator set comprises a generator and reciprocating engine driving the generator, the engine being one of a diesel and gasoline fired engine.

21. The transportable wash unit of claim 20, wherein the generator is one of a fifty (50) and sixty (60) hertz (hz) capacity generator.

22. The transportable wash unit of claim 21, wherein the engine drives the generator at a voltage of between four hundred (400) and four hundred eighty (480) volts at thirty (30) amperes at three (3) phase power.

23. The transportable wash unit of claim 19, wherein the unit controller is an integrated unit controller further configured to monitor and control the engine-generator set and reservoir tank fill.

24. The transportable wash unit of claim 23, wherein access to the unit controller is regulated via a password protection module.

25. The transportable wash unit of claim 1, wherein the unit controller is an automated controller and is controlled by one of a programmable logic controller (PLC) and a personal computer system.

26. The transportable wash unit of claim 25, wherein the unit controller comprises a memory for storing user-defined washing procedures as callable routines and equipment-specific information.

27. The transportable wash unit of claim 26, wherein the unit controller is further configured to automatically call and implement a predetermined wash procedure from a file stored in the controller memory in response to engine type recognition information provided by the reading device.

28. The transportable wash unit of claim 27, wherein a unit controller is configured to satisfy permissives related to at least one of fluid quality, fluid temperature, reservoir fill, and wash fluid configuration.

29. The transportable wash unit of claim 28, wherein the unit controller further comprises a display having a touch screen menu for use in calling a predetermined wash procedure.

30. The transportable wash unit of claim 1, wherein the mobility unit comprises at least one of a transportable skid, a trailer, and a truck bed.

31. The transportable wash unit of claim 1, further comprising one or more reels of hoses, each reel being used in at least one of conducting washing procedures, transferring fluid for washing, electrical grounding the transportable wash unit, and providing a compressed air supply.

32. The transportable wash unit of claim 1, wherein one or more components of the wash unit are interchangeably attached, thereby facilitating maintenance and replacement of said components.

33. The transportable wash unit of claim 1, further comprising one or more protective panels for securing the transportable wash unit and for providing weather protection.

34. The transportable wash unit of claim 1, further comprising one or more ancillary tools for use in preparing a surface desired to be washed.

35. The transportable wash unit of claim 34, wherein the one or more ancillary tools comprises one or more hand tools.

36. The transportable wash unit of claim 1, further comprising one or more compressors for use in purging excess wash fluid from a turbine engine and a manifold.

37. A transportable wash unit comprising:

a wash fluid delivery system for delivering wash fluid to a desired washing location;

a power supply for providing power to components of the transportable washing unit;

a unit controller for controlling one or more components of the transportable wash unit;

a reading device configured to recognize a particular engine type being washed; and a mobility unit for mobilizing the transportable wash unit; wherein the unit controller is adapted to select a particular wash application based on the particular engine type being washed, and wherein the unit controller is configured to satisfy permissives related to at least one of fluid quality, fluid temperature, reservoir fill, and wash fluid configuration.

* * * * *